US005213154A

United States Patent [19]

Marsala et al.

[11] Patent Number: 5,213,154

[45] Date of Patent: May 25, 1993

[54] LIQUID DESICCANT REGENERATION SYSTEM

[75] Inventors: Joseph Marsala, Glen Ellyn, Ill.; Mark W. Spatz, East Amherst, N.Y.

[73] Assignee: Gas Research Institute, Chicago, Ill.

[21] Appl. No.: 930,898

[22] Filed: Aug. 17, 1992

[51] Int. Cl.[5] ..... F29D 5/02

[52] U.S. Cl. ..... 165/115; 165/118; 165/914

[58] Field of Search ..... 165/115, 117, 118, 914

[56] References Cited

U.S. PATENT DOCUMENTS

| | | | |
|---|---|---|---|
| 778,717 | 12/1904 | Stack | 165/118 |
| 955,481 | 4/1910 | Skidd | 165/118 |
| 1,230,960 | 6/1917 | Wearn | 165/117 |
| 1,511,722 | 10/1924 | Dickerman | 165/118 |
| 1,987,123 | 1/1935 | Morrow | 165/118 |
| 2,114,787 | 4/1938 | Smith | 62/171 |
| 2,192,124 | 2/1940 | Brill et al. | 165/115 |
| 2,425,417 | 8/1947 | Booth | 62/139 |
| 2,446,289 | 8/1948 | Love et al. | 165/118 |
| 2,479,936 | 8/1949 | Kelley | 62/139 |
| 2,842,195 | 7/1958 | Eckstrom | 159/31 |
| 3,200,606 | 8/1965 | Hewett et al. | 62/176 |
| 3,527,281 | 9/1970 | Hamill | 159/17 |
| 4,180,985 | 1/1980 | Northrup, Jr. | 62/94 |
| 4,309,364 | 1/1982 | Van Ness et al. | 261/29 |
| 4,427,053 | 1/1984 | Klaren | 165/1 |
| 4,519,448 | 5/1985 | Allo et al. | 165/118 |
| 4,939,906 | 7/1990 | Spatz et al. | 62/94 |

FOREIGN PATENT DOCUMENTS

| | | | |
|---|---|---|---|
| 328401 | 7/1903 | France | 165/118 |
| 8115 | of 1903 | United Kingdom | 165/118 |

*Primary Examiner*—Martin P. Schwadron
*Assistant Examiner*—L. R. Leo
*Attorney, Agent, or Firm*—Lorusso & Loud

[57] ABSTRACT

A single-stage desiccant regeneration system for use in an air conditioning system, the regeneration system comprising a falling film heat exchanger for transferring heat from concentrated desiccant to dilute desiccant, a boiler for regenerating dilute desiccant, piping for flowing dilute desiccant from the air conditioning system upward through the heat exchanger, and a flow path for directing concentrated desiccant from the boiler through the heat exchanger and to the air conditioning system.

8 Claims, 2 Drawing Sheets

LIQUID DESICCANT REGENERATION SYSTEM

BACKGROUND OF THE INVENTION

1. Field of the Invention

This invention relates to liquid desiccant regeneration systems for use in air-conditioning systems, and is directed more specifically to a single stage desiccant regeneration system including a falling film heat exchanger.

2. Description of the Prior Art

Devices that use hygroscopic liquids, such as lithium chloride (LiCl), to dehumidify air are well known in the art. One of the principal limitations of such systems is the need to regenerate the desiccant once it has become diluted through absorption of water. Regeneration usually requires heating the desiccant to drive off the excess moisture, or exposing the desiccant to a hot gas which absorbs the excess moisture. Regenerators in which air serves as the hot gas are often employed, but are expensive to run, especially when waste heat for heating the air is not readily available. Boiler-type regenerators are also used, but are expensive inasmuch as a heating means must be provided and non-corrosive metals must be employed. An improved boiler-type regenerator is disclosed in U.S. Pat. No. 4,939,906 to Spatz, et al, which uses natural circulation of the desiccant being heated. The boiler in the '906 patent is provided with finned tubes through which desiccant being heated passes in an upward direction. The finned tubes are inside a housing containing gas combustion products which serve as a heat source for the boiler. Natural circulation is achieved by providing downcomer tubes which are outside the housing and at a lower temperature. The '906 patent also discloses a means for preheating the diluted desiccant before it enters the boiler for final regeneration. The means employed comprises a two-stage heat-exchanger for transferring heat from concentrated desiccant exiting the boiler to dilute desiccant exiting the air conditioner. The heat transfer takes place in a heat exchanger formed by stacking corrugated plates to form alternating flow channels—one for diluted desiccant and one for concentrated desiccant. The plates are sealed from each other by gasketing. Although the system provides for higher efficiency and lower costs, it is not without drawbacks. The need for gasketing to seal the plates from each other causes pressure to build up unevenly in the flow channels, which can lead to formation of "hot spots" and, thus, lower heat transfer efficiency.

SUMMARY OF THE INVENTION

An object of the present invention is to provide a single stage desiccant regeneration system which overcomes the above-mentioned problems and is more efficient and less complex than the prior art desiccant regeneration systems.

A further object of the invention is to provide as a part of the single stage desiccant regeneration system a novel falling film heat exchanger.

With the above and other objects in view, as will hereinafter appear, a feature of the present invention is the provision of a single-stage desiccant regeneration system for use in an air conditioning system, the regeneration system comprising a falling film heat exchanger for transferring heat from concentrated desiccant solution to dilute desiccant solution from an air conditioner, the falling film heat exchanger comprising a housing, a vertical cylindrical tube disposed in the housing, a generally helically wound tube mounted on and around the vertical cylindrical tube, a distributor for distributing concentrated desiccant evenly onto an outer surface of the vertical cylindrical tube, a spacer separating the vertical cylindrical tube and the helically wound tube from the housing, the housing having a bottom portion for trapping concentrated desiccant, a direct fired natural circulation desiccant boiler for regenerating dilute desiccant and vaporizing moisture absorbed in the dilute desiccant, means for flowing dilute desiccant from the air conditioning system upward through the heat exchanger wound tube to the boiler, and means for directing concentrated desiccant from the boiler through the heat exchanger to the air conditioning system.

In accordance with a further feature of the invention, there is provided a falling film heat exchanger for use in a desiccant regeneration system, the heat exchanger comprising a vertical, cylindrical tube adapted to direct the flow of concentrated desiccant by gravity down its outer surface, a generally helically wound tube fixed on and about the vertical cylindrical tube for transporting diluted desiccant in an upward direction in a generally helical path, a housing in which the vertical cylindrical tube and the helically wound tube are disposed, the housing having a bottom portion for trapping concentrated desiccant, the housing further having a diluted desiccant inlet and a concentrated desiccant outlet at the bottom portion, and a diluted desiccant outlet and a concentrated desiccant inlet at a top portion thereof, the configuration of the vertical cylindrical tube, the helically wound tube and the housing being such that concentrated desiccant flowing down the outer surface of the vertical cylindrical tube contacts the helically wound tube and exchanges heat with diluted desiccant flowing therein, and being such that a portion of concentrated desiccant flows along an outer surface of the helically wound tube in a downward helical path while a remaining portion of the concentrated desiccant spills over the helically wound tube and onto a lower portion of the helically wound tube and into the bottom portion of the housing, and a concentrated desiccant outlet disposed in the housing and proximate the bottom portion, a distributor for evenly distributing concentrated desiccant on the outer surface of the vertical tube, and means for separating the housing from the vertical and helically wound tubes.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENT

Figure 1:
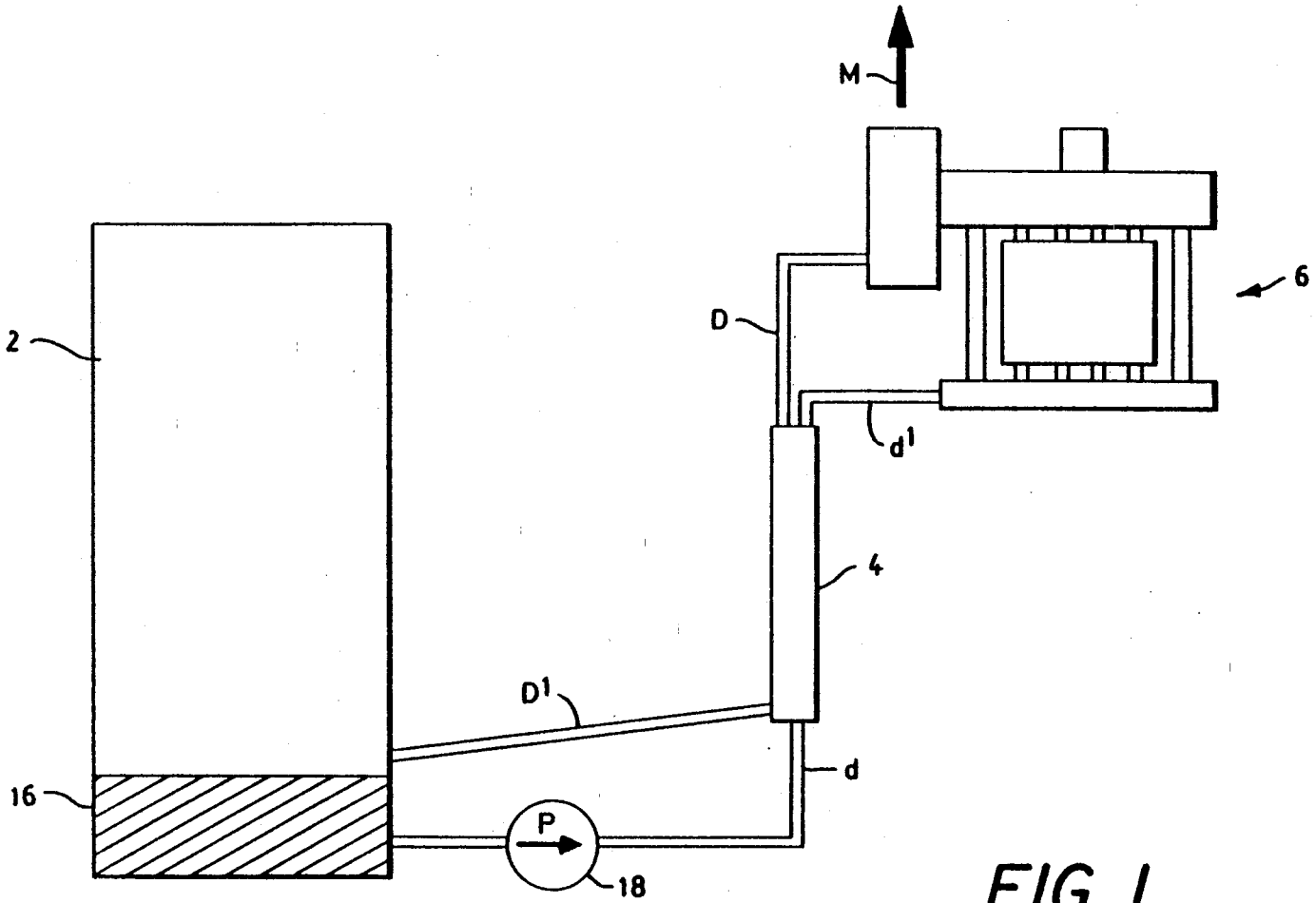
FIG. 1 is a diagrammatic view of one form of desiccant regeneration system, illustrative of an embodiment of the invention.

Referring to FIG. 1, it will be seen that the regeneration process includes flowing of desiccant d from an air conditioner 2 through a falling film heat exchanger 4. In the heat exchanger 4, heat from concentrated desiccant D exiting a boiler 6 is transferred to the dilute desiccant d exiting the air conditioner 2. The regeneration process continues by piping heated dilute desiccant d' to the gas fired natural circulation desiccant boiler 6, where the desiccant is heated and excess moisture M is driven off. Newly-concentrated desiccant D is then piped back through the falling film heat exchanger 4 to exchange heat with the dilute desiccant d from the air conditioner 2. The concentrated and cooled desiccant D' then continues on to the air conditioner 2 where it is utilized for dehumidifying purposes.

Figure 2:
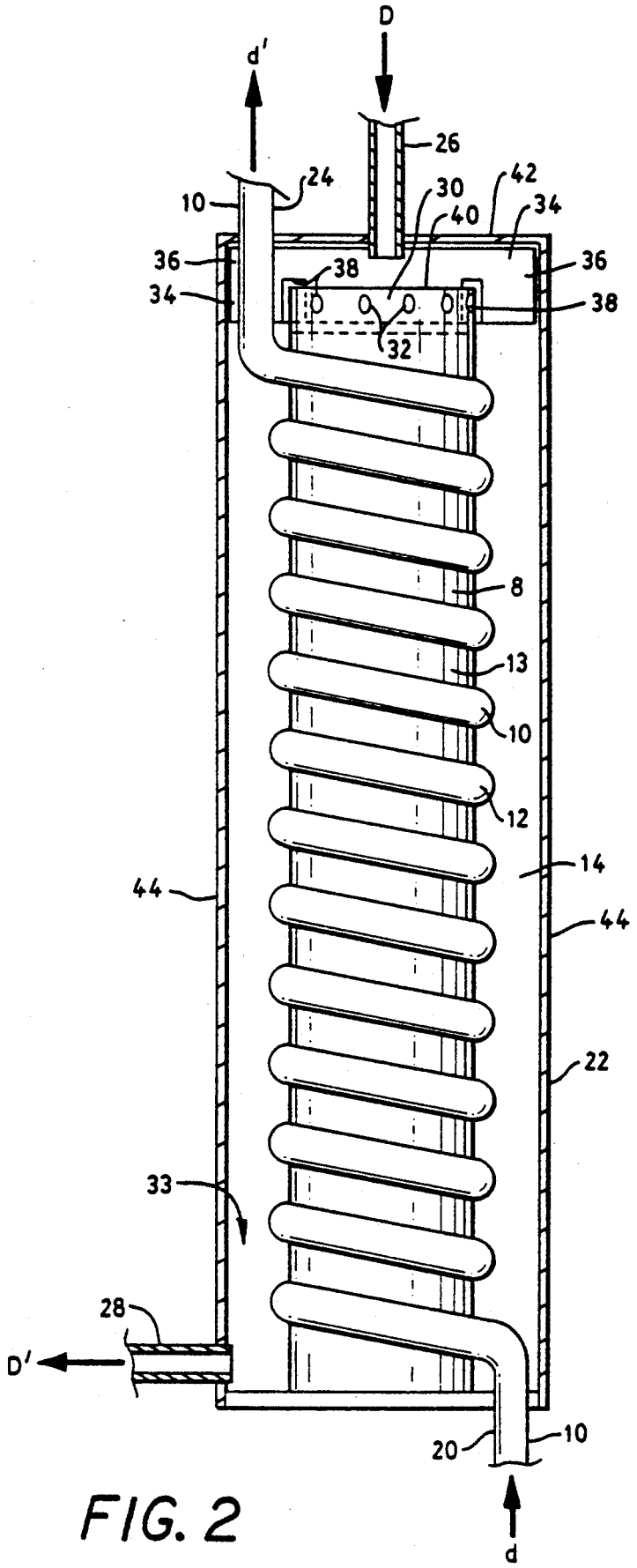
FIG. 2 is a side elevational view, partly in section, of one form of falling film heat exchanger, illustrative of an embodiment of the invention.

Referring to FIG. 2, it will be seen that the falling film heat exchanger 4 of the present invention uses falling film technology to improve the heat exchange effectiveness over previous systems. In the falling film heat exchanger 4, the hot concentrated desiccant D flows by gravity downward along the exterior of a central, vertical tube 8. Wrapped around the central tube 8 in a generally helical fashion is another tube 10, which carries the dilute desiccant d, d'. The dilute desiccant d, d' is pumped upward through the helical tubing 10. As the concentrated desiccant D falls, it contacts the helical tubing 10 and transfers heat through the walls of the tubing 10 to the dilute desiccant contained therein. The concentrated desiccant D then continues falling by gravity, in part spilling over the helical tubing 10 to a lower portion of the tubing, and in part flowing down and around on an outside surface 12 of the helical tubing. This extended contact with the helical tubing improves the efficiency of the falling film heat exchanger as compared to other heat exchangers. The effectiveness is further enhanced by the absence of pressure differentials resulting in "hot spots" and uneven heat transfer. No pressure problems exist as the concentrated desiccant simply falls in an open chamber 14 that does not have to be sealed. The effectiveness is also enhanced by the concentrated desiccant being evenly distributed over the outside surface 13 of the central tube 8 by a distributor (described herein below) designed for that purpose. A heat exchange effectiveness of 89% has been realized.

A typical liquid desiccant, such as LiCl, may be employed by the air conditioner 2 for removing excess moisture from air being conditioned. As the desiccant dehumidifies the air being conditioned, the moisture-absorbing capability of the desiccant is lessened, and it must be regenerated. The dilute desiccant d is collected in a sump 16 in the air conditioner 2 (FIG. 1). From the sump 16, the dilute desiccant d is flowed, as by a pump 18, to a dilute desiccant inlet 20 (FIG. 2) in a housing 22 of the falling film heat exchanger 4. In the falling film heat exchanger, the temperature of the dilute desiccant d is raised. The warmer dilute desiccant d' is then piped out of a dilute desiccant outlet 24 of the housing 22 to the gas fired natural circulation desiccant boiler 6 (FIG. 1). In the desiccant boiler 6, the desiccant d' is regenerated by being heated, and the excess moisture M being driven off. In addition to being concentrated, the desiccant D is now at an elevated temperature. To make effective use of this heat, the concentrated desiccant D is piped into a concentrated desiccant inlet 26 of the housing 22 (FIG. 2). From there, the concentrated desiccant D continues through the falling film heat exchanger 4 and imparts heat to the dilute desiccant d, d' therein. The cooler concentrated desiccant D' then leaves the falling film heat exchanger through a concentrated desiccant outlet 28 in the housing 22 and flows back to the sump 16 in the air conditioner 2 (FIG. 1).

As noted above, the hot, concentrated desiccant D enters the falling film heat exchanger 4 (FIG. 2) through the concentrated desiccant inlet 26 in the housing 22. All of the motion of the concentrated desiccant D is caused by gravity, thus obviating any need to pump the concentrated desiccant, and further obviating any possible accompanying pressure differentials.

The concentrated desiccant D is first directed to a distributor 30. The distributor 30 is adapted to evenly distribute the concentrated desiccant D. The distributor 30 momentarily contains the flow of the concentrated desiccant D. The concentrated desiccant falling into the distributor 30 fills the distributor until the desiccant level in the distributor reaches the level of holes 32 spaced about the periphery of the distributor. The concentrated desiccant D flows through the holes 32 and onto the central tube 8 in an even manner. As the concentrated desiccant falls down the central tube, the desiccant makes contact with the helical tubing 10. The helical tubing 10 contains the dilute desiccant d, d' being pumped from the sump 16 of the air conditioner 2 to the gas fired natural circulation desiccant boiler 6. Contact between the falling concentrated desiccant D and the helically wound tubing 10 causes the concentrated desiccant to transfer heat to the wall of the helically wound tubing and thus to the dilute desiccant contained d, d' therein. From the point of contact, the concentrated desiccant follows one, or both, of two paths. The falling desiccant maintains contact with the helically wound tubing 10 and thereby follows a first downward helical path, while portions of the concentrated desiccant may spill over the helically wound tubing and fall to lower portions of the helically wound tubing. As the concentrated desiccant continues downward by either the first, or both paths, it continues to exchange heat with the dilute desiccant in the helical tubing whenever it is in contact with the helical tubing. When the concentrated desiccant reaches a bottom portion 33 of the housing 22, it is trapped and begins to fill the housing until reaching the level of the concentrated desiccant outlet 28 in the housing, whereupon the concentrated and cooled desiccant D' flows out of the housing and to the sump 16 of the air conditioner 2.

A spacer member 34 may be provided at the upper end of the heat exchanger 4 to insure location of the central tube 8 centrally of the housing 22 and to insure that the periphery of the helical tubing 10 is spaced from the housing 22. The spacer member 34 may comprise a plurality of fins 36 connected together and arranged in radial fashion. Each of the fins 36 is provided with a notch 38 adapted to receive an upper edge portion 40 of the central tube 8. The fins 36 extend radially outwardly from the central tube 8 a distance further than the extent of any portion of the helical tube 10 from the central tube, including the dilute desiccant inlet 20 and the dilute desiccant outlet 24. In assembly, after placement of the vertical central tub 8 and helical tube 10 in the housing 22, the spacer member 34 is placed over the upper edge portion 40 of the central tube 8, with the notches 38 receiving the upper edge portion 40. A housing top plate 42, when fixed to the housing 22, locks the spacer in place. The spacer, in turn, locks the central tube 8 in place. The central location of the central tube 8 insures that the helical tube 10 is appropriately centered and therefore distanced from housing side walls 44.

The high heat exchange effectiveness of the falling film heat exchanger 4 derives largely from the fact that the concentrated desiccant D, D' maintains contact with the helical tube 10 for a majority of the time the desiccant is in the heat exchanger. Also, the low pressure drop from top to bottom of the falling film heat exchanger insures that no "hot spots" develop to impede heat transfer effectiveness. Heat transfer effectiveness is also increased by selecting a material with a high thermal conductivity for the vertical central tube 8 and the helically wound tube 10. In one embodiment, a non-corrosive metal alloy such as copper-nickel is used. In an alternative embodiment, polysulfone is used. Since liquid desiccant is a corrosive liquid, all of the elements of the falling film heat exchanger are composed of non-corrosive materials.

The present invention thus provides an efficient and economic means to regenerate liquid desiccant used in an air conditioning system for dehumidification. The single stage regenerator reconditions the desiccant by utilizing a falling film heat exchanger and a gas fired natural circulation desiccant boiler. The falling film heat exchanger makes effective use of the heat imparted to concentrated desiccant in the boiler by transferring it to dilute desiccant that is pumped through the falling film heat exchanger. The preheated desiccant is then piped to the boiler where it is heated, and the excess vapor is driven off, concentrating the desiccant. The concentrated desiccant is then passed through the falling film heat exchanger where it imparts heat to dilute desiccant before returning to the air conditioner where it is used for dehumidifying air.

While the foregoing invention has been described with reference to its preferred embodiments, various alterations and modifications will occur to those skilled in the art. For example, a variety of materials can be utilized to fabricate the elements of the falling film heat exchanger. Also, various liquid desiccants can be used with the present invention. These and other such alterations are intended to fall within the scope of the following claims.

Having thus described our invention, what we claim as new and desire to secure by Letters Patent of the United States is:

1. A single-stage desiccant regeneration system for use in an air conditioning system, said regeneration system comprising:

a falling film heat exchanger for transferring heat from concentrated desiccant solution to dilute desiccant solution, said heat exchanger comprising a housing, a vertical cylindrical tube disposed in said housing, a generally helically wound tube mounted on and around said vertical cylindrical tube, a distributor for distributing concentrated desiccant evenly onto an outer surface of said vertical cylindrical tube, a spacer separating said vertical cylindrical tube and said helically wound tube from side walls of said housing, said spacer comprising a plurality of fins connected together and arranged in radial fashion, each of said fins having therein a notch in which is received an upper edge portion of said vertical cylindrical tube, said fins extending radially outwardly from said vertical cylindrical tube a distance further than the extent of any portion of said helically wound tube from said vertical cylindrical tube, outer edges of said fins being adjacent said side walls of said housing, said housing having a bottom portion for trapping concentrated desiccant, a boiler for regenerating dilute desiccant and vaporizing moisture absorbed in said dilute desiccant, means for flowing dilute desiccant from said air conditioning system upward through said heat exchanger wound tube to said boiler, and means for directing concentrated desiccant from said boiler through said heat exchanger to said air conditioning system.

2. The single stage desiccant regenerator system according to claim 1, wherein said vertical cylindrical tube, said helically wound tube and said housing are configured such that concentrated desiccant flowing down said outer surface of said vertical cylindrical tube contacts said helically wound tube and exchanges heat with diluted desiccant flowing therein, and are further configured such that a portion of concentrated desiccant flows along an outer surface of said helically wound tube in a downward helical path, and a remaining portion of said concentrated desiccant spills over said helically wound tube and onto a lower portion of said helically wound tube and said bottom portion of said housing, and a concentrated desiccant outlet in said housing proximate said bottom portion and adapted to convey concentrated desiccant from said housing.

3. The single stage desiccant regeneration system according to claim 2, wherein said vertical cylindrical tube, said helically wound tube, said housing, said distributor and said spacer are composed of non-corrosive material.

4. The single stage desiccant regenerator system according to claim 3, wherein said vertical cylindrical tube and said helically wound tube are composed of material with a high thermal conductivity thereby facilitating said heat exchange from concentrated desiccant to dilute desiccant.

5. A falling film heat exchanger for use in a desiccant regeneration system, said heat exchanger comprising:

a vertical cylindrical tube adapted to direct the flow of concentrated desiccant by gravity down its outer surface, a generally helically wound tube fixed on and about said vertical cylindrical tube for transporting diluted desiccant in an upward direction in a generally helical path, a housing in which said vertical cylindrical tube and said helically wound tube are disposed, said housing having a bottom portion for trapping concentrated desiccant, said housing further having a diluted desiccant inlet and a concentrated desiccant outlet at said bottom portion, and a diluted desiccant outlet and a concentrated desiccant inlet at a top portion thereof, said vertical cylindrical tube, said helically wound tube and said housing being configured such that concentrated desiccant flowing down said outer surface of said vertical cylindrical tube contacts said helically wound tube and exchanges heat with diluted desiccant flowing therein, and such that a portion of concentrated desiccant flows along an outer surface of said helically wound tube in a downward helical path while a remaining portion of concentrated desiccant spills over said helically wound tube and onto a lower portion of said helically wound tue and into said bottom portion of said housing, a distributor for evenly distributing concentrated desiccant on said outer surface of said vertical tube, and means for separating side walls of said housing from said vertical and helically wound tubes, comprising a spacer member, said spacer member comprising a plurality of fins connected together and arranged in radial fashion, each of said fins having therein a notch in which is received an upper edge portion of said vertical tube, said fins extending radially outwardly from said vertical tube a distance further than the extent of any portion of said helical tube from said vertical tube, outer edges of said fins being adjacent said side walls of said housing, whereby to space said vertical tube and said helical tube from said housing side walls.

6. The falling film heat exchanger according to claim 5, wherein said distributor comprises a cylindrical shell with a bottom and with holes arranged in a plane parallel to said bottom in a periodic fashion around the circumference of said cylindrical shell, said distributor being adapted to be disposed on top of said vertical tube such that concentrated desiccant enters said housing through said concentrated desiccant inlet in said housing and is received by said distributor and fills said distributor until the level of concentrated desiccant reaches said planar periodically arranged holes, whereupon concentrated desiccant flows through said holes and onto said vertical cylindrical tube in said even manner.

7. The falling film heat exchanger according to claim 6, wherein said vertical cylindrical tube, said helically wound tube, said housing, said distributor and said spacer are composed of non-corrosive material.

8. The falling film heat exchanger according to claim 6, wherein said vertical cylindrical tube and said helically wound tube are composed of material with a high thermal conductivity, thereby facilitating said heat exchange from said concentrated desiccant to said dilute desiccant.

* * * * *